United States Patent [19]

Sizer et al.

[11] Patent Number: 4,515,220

[45] Date of Patent: May 7, 1985

[54] APPARATUS AND METHOD FOR ROTATING COIL TUBING IN A WELL

[75] Inventors: Phillip S. Sizer, Farmers Branch; Don C. Cox, Roanoke; Malcolm N. Council, Richardson, all of Tex.

[73] Assignee: Otis Engineering Corporation, Dallas, Tex.

[21] Appl. No.: 560,866

[22] Filed: Dec. 12, 1983

[51] Int. Cl.[3] ..... E21B 19/22

[52] U.S. Cl. ..... 166/384; 166/78; 166/85; 254/29 R

[58] Field of Search ..... 166/77, 77.5, 78, 85, 166/384; 414/745; 254/29 R, 30

[56] References Cited

U.S. PATENT DOCUMENTS

| | | | |
|---|---|---|---|
| 3,191,450 | 6/1965 | Wilson | 74/219 |
| 3,215,203 | 11/1965 | Sizer | 166/77 |
| 3,216,731 | 11/1965 | Pollison | 277/1 |
| 3,285,485 | 11/1966 | Slator . | |
| 3,313,346 | 4/1967 | Cross . | |
| 3,559,905 | 2/1971 | Palynchuk | 242/54 |
| 3,690,136 | 9/1972 | Slator et al. | 72/160 |
| 3,754,474 | 8/1973 | Palynchuk | 74/162 |
| 3,828,852 | 8/1974 | Delano | 166/78 |
| 3,865,408 | 2/1975 | Young | 285/3 |
| 3,951,208 | 4/1976 | Delano | 166/78 |
| 4,085,796 | 4/1978 | Council | 166/77.5 |
| 4,251,176 | 2/1981 | Sizer et al. | 414/22 |

*Primary Examiner*—Stephen J. Novosad
*Assistant Examiner*—William P. Neuder
*Attorney, Agent, or Firm*—Albert W. Carroll

[57] ABSTRACT

Improved coil tubing injection apparatus for servicing wells by running coil tubing thereinto for circulating fluids through the well and having the ability to rotate the coil tubing for performing drilling operations. The apparatus can readily provide concurrent longitudinal and rotational movement of the coil tubing. Methods of servicing wells involving such movement of coil tubing are disclosed.

39 Claims, 22 Drawing Figures

APPARATUS AND METHOD FOR ROTATING COIL TUBING IN A WELL

BACKGROUND OF THE INVENTION

1. Field of the Invention

This invention relates to the servicing of wells through use of coil tubing and more particularly to apparatus for and methods of rotating coil tubing in a well for performing downhole operations therein.

2. Description of the Prior Art

It has been common practice for many years to run a continuous reeled pipe (known extensively in the industry as "coil tubing") into a well to perform operations utilizing the circulation of treating fluids such as water, oil, acid, corrosion inhibitors, cleanout fluids, hot oil, and the like fluids. Coil tubing being continuous, rather than jointed, is run into and out of a well with continuous movement of the tubing through use of a coil tubing injector. This is much quicker than running jointed pipe whose threaded connections consume much time in making and breaking, that is, in assembling and disassembling, or putting them together and taking them apart. Coil tubing injectors are well known in the oil and gas industry.

Coil tubing is frequently used to circulate cleanout fluids through a well for the purpose of eliminating sand bridges or other obstructions therein. Often such sand bridges or other obstructions are very difficult and quite occasionally impossible to remove because of the inability to rotate the coil tubing to drill out such obstructions. Turbo-type drills have been used but have been found to develop insufficient torque for many jobs.

Thus, it is desirable to perform drilling operations in wells through use of coil tubing which can be run into and removed from a well quickly and which can be rotated to perform various and desirable drilling operations such as the removal of obstructions, while also performing the usual operations which require only the circulation of fluids.

Known prior art relating to the present invention includes: U.S. Pat. Nos. 3,191,450; 3,216,731; 3,559,905; 3,865,408; 3,191,981; 3,285,485; 3,690,136; 4,085,796; 3,215,203; 3,313,346; 3,754,474; 4,251,176.

U.S. Pat. No. 3,285,485 which issued to Damon T. Slator on Nov. 15, 1966 discloses a device for handling tubing and the like. This device is capable of injecting reeled tubing into a well through suitable seal means, such as a blowout preventer or stripper, and is currently commonly known as a coil tubing injector.

U.S. Pat. No. 3,313,346 issued Apr. 11, 1967 to Robert V. Cross and discloses methods and apparatus for working in a well using coil tubing.

U.S. Pat. No. 3,690,136 which issued on Sept. 12, 1972 to Damon T. Slator et al discloses apparatus for use with a coil tubing injector to both guide and straighten the coil tubing. The apparatus guides the coil tubing between the reel and the injector with minimal permanent deformation and then straightens the coil tubing when permanent deformation occurs.

U.S. Pat. No. 3,559,905 which issued to Alexander Palynchuk on Feb. 2, 1971 discloses an improved coil tubing injector having a chain drive mechanism which includes not only the usual endless track or drive chain with gripper pads thereon for gripping the coil tubing, but also has an endless roller chain within the track to reduce the friction between the track and the pressure beam, thus providing a good grip on the coil tubing while requiring less horesepower to drive the tracks. This patent also discloses methods and apparatus for running coil tubing into and out of a well without deforming it permanently. Of course, this has no bearing upon the present invention, but the injector with the roller chain within the track is similar to the injector of the present invention which is an improvement thereover.

U.S. Pat. No. 3,754,474 which issued to Alexander Palynchuk on Aug. 28, 1973 discloses an improved gripper pad for use on a track or drive chain of a coil tubing injector.

U.S. Pat. No. 3,215,203 issued to Phillip S. Sizer on Nov. 2, 1965. This patent illustrates and describes apparatus for snubbing jointed pipe into a well against well pressure. A guide tube is provided to prevent buckling of the pipe under heavy column loads. The snubbing apparatus includes both stationary and traveling hydraulically operated slips or grippers of a type usable with the present invention.

U.S. Pat. No. 4,085,796 which issued to Malcolm N. Council on Apr. 25, 1978 illustrates and describes snubbing apparatus similar to that disclosed in U.S. Pat. No. 3,215,203 supra. This patent, in addition, discloses a spline arrangement for maintaining axial alignment of its pistons with its hydraulic cylinders.

U.S. Pat. No. 3,216,731 which issued to William D. Dollison on Nov. 9, 1965 illustrates and describes apparatus including a plurality of strippers, back pressure regulators, and relief valves arranged to step down high well pressure by providing a pressure drop across each stripper in series so that pipe can be snubbed into a well having a surface pressure far greater than that considered safe with the usual stripper arrangement.

U.S. Pat. No. 4,251,176 issued to Phillip S. Sizer and Malcolm N. Council on Feb. 17, 1981 and illustrates and describes apparatus for snubbing pipe into a well. This equipment is shown to use stationary slips or grippers of the general type shown in U.S. Pat. No. 3,215,203, supra, and which could be used in the apparatus of the present invention.

U.S. Pat. No. 3,191,450 which issued to J. H. Wilson on June 29, 1965 illustrates and describes a fluid driven pipe rotating device such as could be used with the apparatus of the present invention.

U.S. Pat. No. 3,191,981 which issued June 29, 1965 to D. W. Osmun and U.S. Pat. No. 3,865,408 which issued Feb. 11, 1975 to Carter R. Young illustrate and describe packoff-type overshots of a type which could be used to connect jointed pipe to coil tubing for well servicing as taught in the present invention.

None of the prior art of which applicants are aware shows, teaches, or suggests apparatus and/or methods which would make it possible to run a length of coil tubing into a well using a coil tubing injector and then rotate the same while it is in the well. Neither does any of the known prior art suggest adding jointed pipe to the upper end of the coil tubing to extend its penetration into the well and to rotate the string of tubing, let alone while moving it up and/or down in the well.

SUMMARY OF THE INVENTION

The present invention is directed to improved coil tubing injectors having the ability to inject coil tubing into a well and having means for then rotating the coil tubing while it is in the well. The invention further is directed to such apparatus having means for adding jointed pipe to the upper end of the coil tubing for extending its reach into the well and for rotating the pipe and/or coil tubing while it is raised or lowered in the well. In addition, the invention is directed to various methods of inserting a length of coil tubing into a well and rotating it, and adding jointed pipe to its upper end to extend its reach into the well.

It is therefore one object of this invention to provide improved coil tubing injection apparatus having means for rotating a length of coil tubing in a well.

Another object is to provide means for attaching jointed pipe to the upper end of said coil tubing to extend the coil tubing to a greater depth in the well.

Another object is to provide apparatus of the character set forth having means for rotating the tubing while moving it up or down in the well.

A further object is to provide tubular quill means for apparatus of the character described for surrounding the coil tubing or pipe and being engageable by the coil tubing injector, the quill having a gripper swivelly attached thereto, and there being means for rotating the gripper to thus rotate the pipe held thereby and the coil tubing suspended from the pipe while the quill is held by the coil tubing injector.

Another object is to provide such apparatus with means for limiting the stroke of the quill means as it is moved up and down by the injector apparatus.

Another object is to provide apparatus of the character described which is driven by hydraulic fluid pressure and wherein the stroke limiting means includes limit valve means operated by hydraulic fluid pressure.

Another object of this invention is to provide a method of running a coil tubing into a well through use of a coil tubing injector and then rotating the coil tubing in the well.

Another object is to provide a method of running coil tubing in a well to a desired depth, cutting the tubing, adding connecting means to its upper end, attaching jointed pipe thereto, and rotating the pipe to rotate the coil tubing in the well.

Another object is to provide a method of the character described wherein a tubular quill is placed about the upper portion of the coil tubing or pipe and is engaged in the coil tubing injector for moving the tubing up or down in the well.

Another object is to provide such a method in which the quill carries means for rotating the pipe or coil tubing extending through it.

Other objects and advantages of this invention will become apparent from reading the description which follows and studying the accompanying drawings, wherein:

DESCRIPTION OF THE PREFERRED EMBODIMENTS

Figure 1:
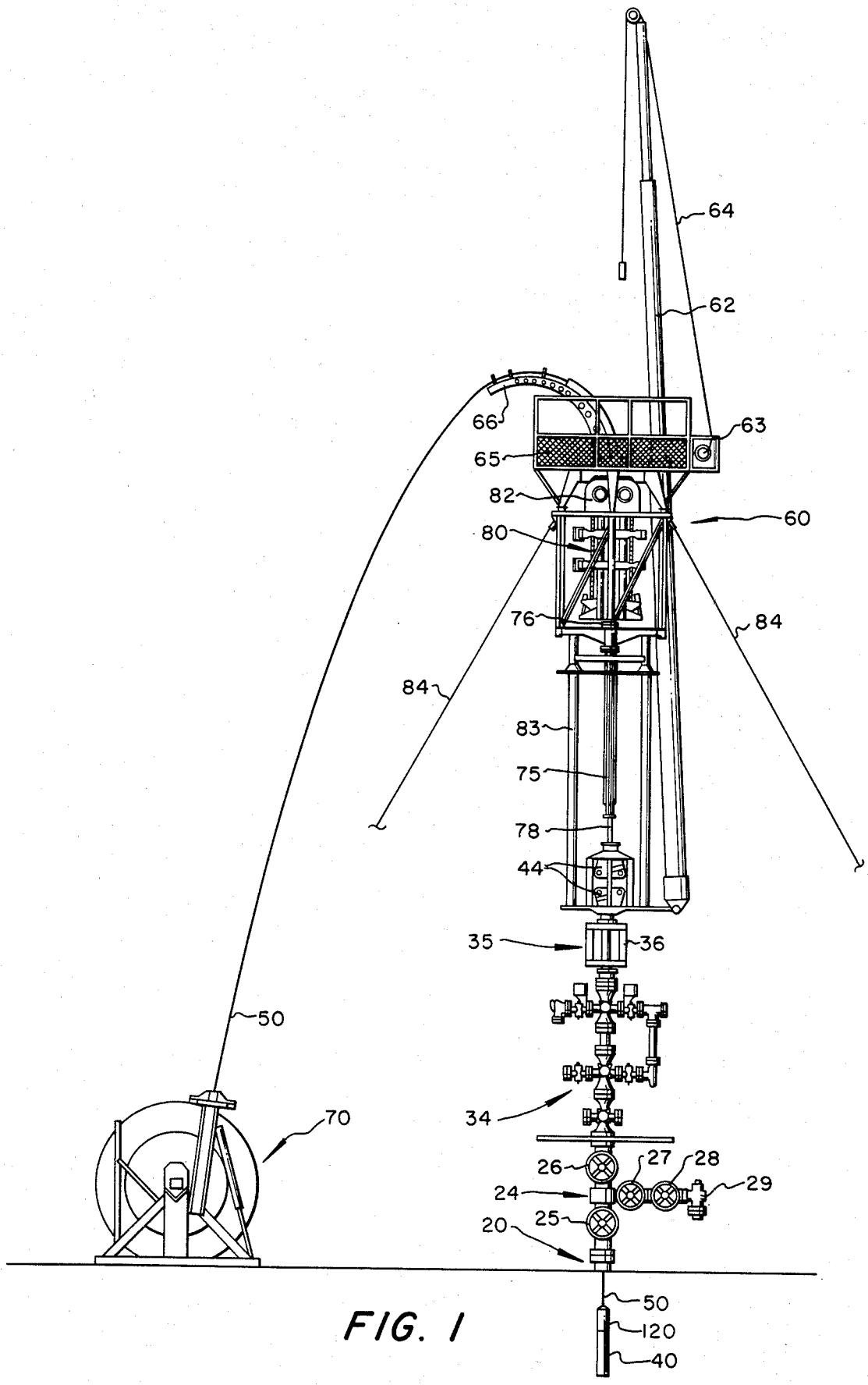
FIG. 1 is a schematical view showing a well having equipment mounted thereon for injecting coil tubing thereinto.

Referring now to FIG. 1, a well 20 is shown being serviced in a manner and through use of apparatus which will now be described.

The well 20 is equipped with suitable surface equipment connections or Christmas tree 24 comprising master valve 25, swab valve 26, wing valves 27 and 28, and choke 29 for controlling the well in the usual manner. Apparatus for practicing the present invention is mounted atop the Christmas tree 24. This apparatuas premits running an operational tool 40 into the well 20 on coil tubing 50 and then rotating the coil tubing in the well. Provisions are made for adding jointed pipe to the upper end of the coil tubing and for even lowering and/or raising the coil tubing while it is being rotated. This apparatus, as seen in FIG. 1, includes a blowout preventer stack 34 for sealing around the coil tubing or pipe to prevent the escape of well fluids, a tripod 35 providing window-like openings between its legs 36 for access to the lower end of the coil tubing for changing operational tools such as the tool 40, a pair of stationary slip assemblies 44 for holding the coil tubing against upward or downward longitudinal movement, a coil tubing injector 60 having a gin pole 62, hoist 63, and hoist line 64, work platform or workbasket 65, and a coil tubing support arm 66. A reel of coil tubing 70 is disposed a convenient distance from the well and feeds coil tubing 50 into the coil tubing injector 60. A quill body 75 surrounds the coil tubing 50 and is suspended in an out-of-the-way position below the injector 60 as shown. A stop plate 76 supports the quill body 75 in the position shown. A guide tube 78 surrounds the coil tubing and has its lower end attached to the stationary slips 44 while its upper portion extends upwardly through the quill body 75. Its upper end remains telescoped into the quill at all times. Thus the guide tube prevents the coil tubing from buckling as it is forced into the well, against well pressure, if any, by the injector.

The heart of the coil tubing injector 60 is the mechanism which forces the coil tubing 50 into and out of the well through the blowout preventers. This mechanism includes a chain-type drive mechanism 80 for gripping the coil tubing, and this mechanism is powered by power means 82 comprising suitable hydraulic motors and transmission (not shown). Pressurized hydraulic fluid is supplied by a power pack (not shown) connected to the hydraulic motors via suitable hoses (not shown). As the chain-type drive mechanism 80 is driven in one direction, coil tubing is forced into the well, and when this mechanism is reversed, coil tubing is withdrawn from the well.

A plurality of legs 83 are used to position the coil tubing injector 60 a spaced distance above the stationary slips 44 to provide space for storing and operating the quill 75. The hoist 63 and gin pole 62 are used, among other things, to lift pipe sections for adding them to or taking them from the upper end of the coil tubing in the well as needed.

A plurality of guy wires or cables 84 have their upper ends secured to the appratus, as shown, and their lower ends anchored to the ground in the usual manner to stabilize the tall structure in its vertical position.

Figure 2:
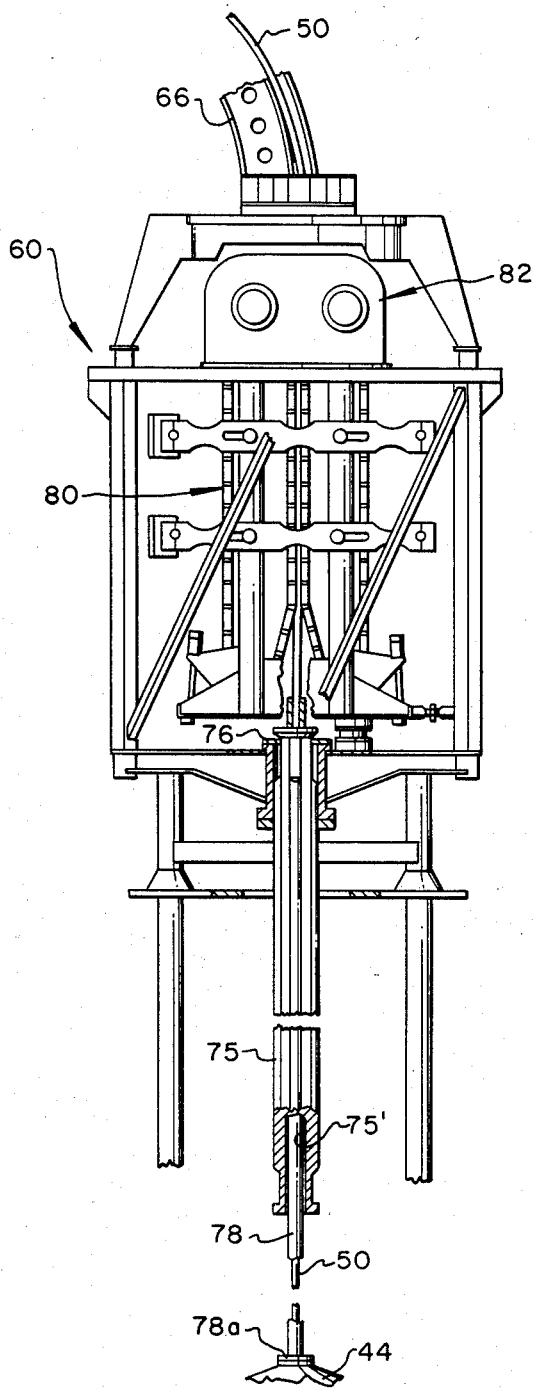
FIG. 2 is a fragmentary schematical view similar to FIG. 1 but to larger scale and showing coil tubing being run into the well.
Figure 3:
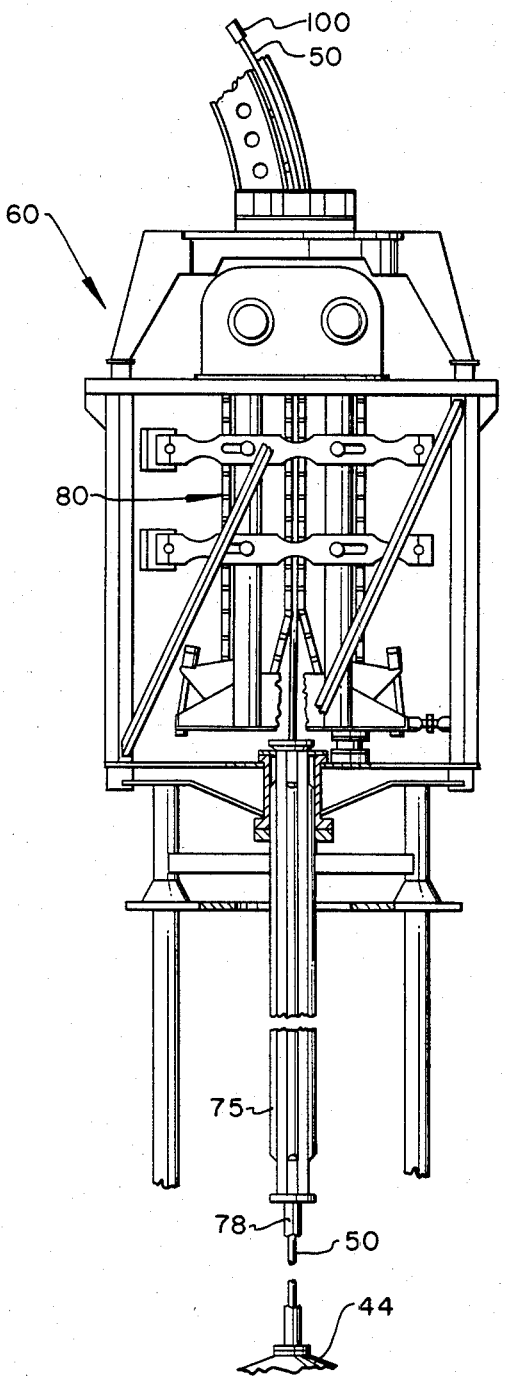
FIG. 3 is a view similar to FIG. 2 but showing the coil tubing with a connector on its upper end.

Referring now to FIGS. 2 and 3, it will be seen that the coil tubing injector 60 is being used to inject coil tubing 50 into the well 20 of FIG. 1. When the operational tool 40 on the lower end of the coil tubing approaches the depth at which rotation of the coil tubing will be required, the stationary slips 44 are engaged to support the coil tubing, the injector's grip on the coil tubing is released, the coil tubing support arm 66 is swung out of the way, and the coil tubing is cut. Then, a threaded connector 100 is attached to the upper end of that portion of coil tubing which projects from the well, as seen in FIG. 3, so that jointed or threaded pipe can be added thereto to extend its length as required.

Figure 4:
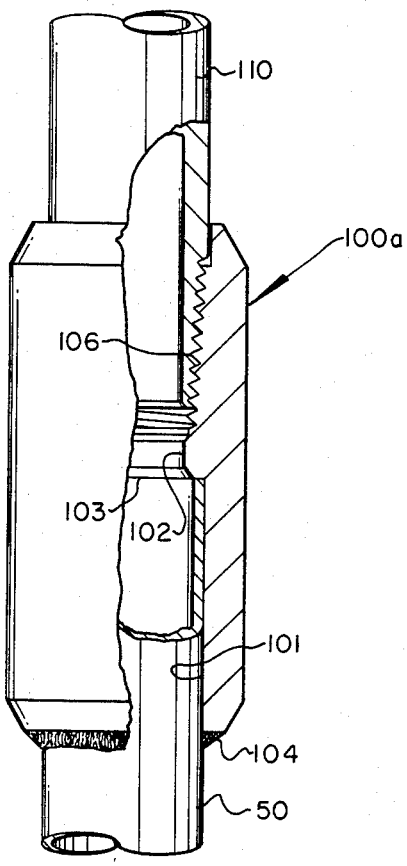
FIG. 4 is a longitudinal view, partly in section and partly in elevation with some parts broken away, showing a welded connector connecting a length of pipe to the upper end of the coil tubing.

Alternatively, if it is known beforetime at which depth an operation is to be performed in a well, the coil tubing can be precut to length and a threaded connector 100*a* welded thereto as seen in FIG. 4.

In FIG. 4, the threaded connector 100*a* is shown to have a downwardly opening bore 101 restricted as at 102 to provide a shoulder 103. Coil tubing 50 has been telescoped into the open bore 101 and abutted against shoulder 103, after which it has been welded in place by pressure-tight circumferential weld 104. The upper end of restricted bore 102 is internally threaded as at 106 for attachment of pipe 110 as shown. Precutting the coil tubing and attaching the connector as seen in FIG. 4 may possibly save considerable time at the well site and is likely to be preferred over cutting of the coil tubing and installing the connector on the job.

If the coil tubing, on the other hand, is to be cut at the well site, as when the working depth is not known before hand, the coil tubing may be run into the well, and when a depth is reached at which the coil tubing needs to be rotated, as when a sand bridge or obstruction is reached, for instance, the coil tubing can be cut. This can be done with a hacksaw after engaging the stationary slips 44 and bleeding the pressure from the coil tubing.

If the well has superatmospheric pressure and cannot be bled to that of the atmosphere, a check valve such as conventional check valve 120 (FIG. 1) must be used in the coil tubing below the place where it is to be cut. The check valve will normally be installed as shown in FIG. 1 between the lower end of the coil tubing 50 and the upper end of the operational tool 40. It is recommended that the check valve be installed whether or not its use is anticipated.

Figure 5:
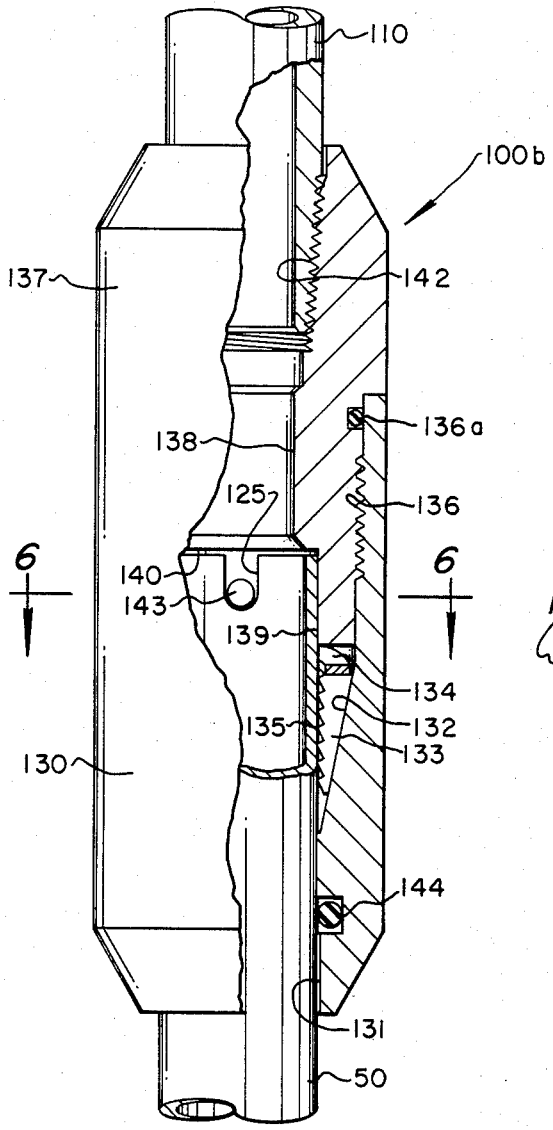
FIG. 5 is a view similar to FIG. 4 showing a connector which is applied without welding.

After cutting the coil tubing with the hacksaw, it must be straightened for a suitable distance. In addition, the end of the tubing must be prepared for attachment of the non-welded connector 100*b* seen in FIGS. 5 and 6. Thus, the end of the coil tubing must be smoothed by filing or applying emery cloth, or the like. The end of the tubing must also be notched in a manner similar to that shown at 125. This notching may be accomplished by first drilling a hole through the tubing near its cut end and then sawing out the waste material to form the notch 125.

Figure 6:
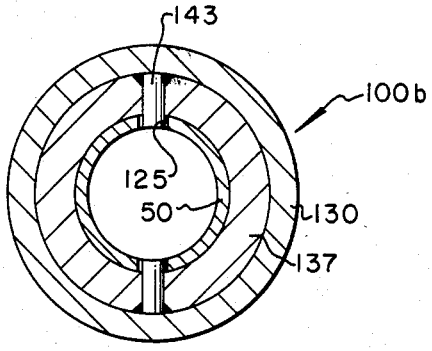
FIG. 6 is a cross-sectional view taken along line 6—6 of FIG. 5.

The connector 100*b* comprises a housing 130, having a bore 131 flared at 132 to recieve tapered slips 133 which are biased by spring means such as spring washer 134 to force teeth 135 thereof into biting engagement with the outer surface of the coil tubing 50. The bore 131 is internally threaded as at 136 to receive the lower threaded end of upper sub 137. Seal ring 136*a* seals this threaded joint. The upper sub 137 has a bore 138 enlarged as at 139 at its lower end to provide downwardly facing shoulder 140, and its upper end is internally threaded as at 142 to receive the lower threaded end of pipe section 110. The upper sub extends downward beyond its external thread, and one or more pins 143 are welded in suitable radial apertures in its wall so that their inner ends project into bore 139 as seen in FIG. 6. A suitable seal ring such as seal ring 144 is disposed in an internal recess in the body 130 as shown to seal between the sub and the coil tubing. The prepared end of the coil tubing is inserted fully into the lower end of the connector and twisting it if necessary to cause the recesses 125 to engage the inwardly projecting pins 143. The slips 133, being spring biased, will bite the coil tubing automatically, and the seal ring 144 will sealingly engage the coil tubing automatically, also. The connector 100*b* will, understandably, withstand an appreciable amount of pressure, tensile load, and torque.

Figure 7:
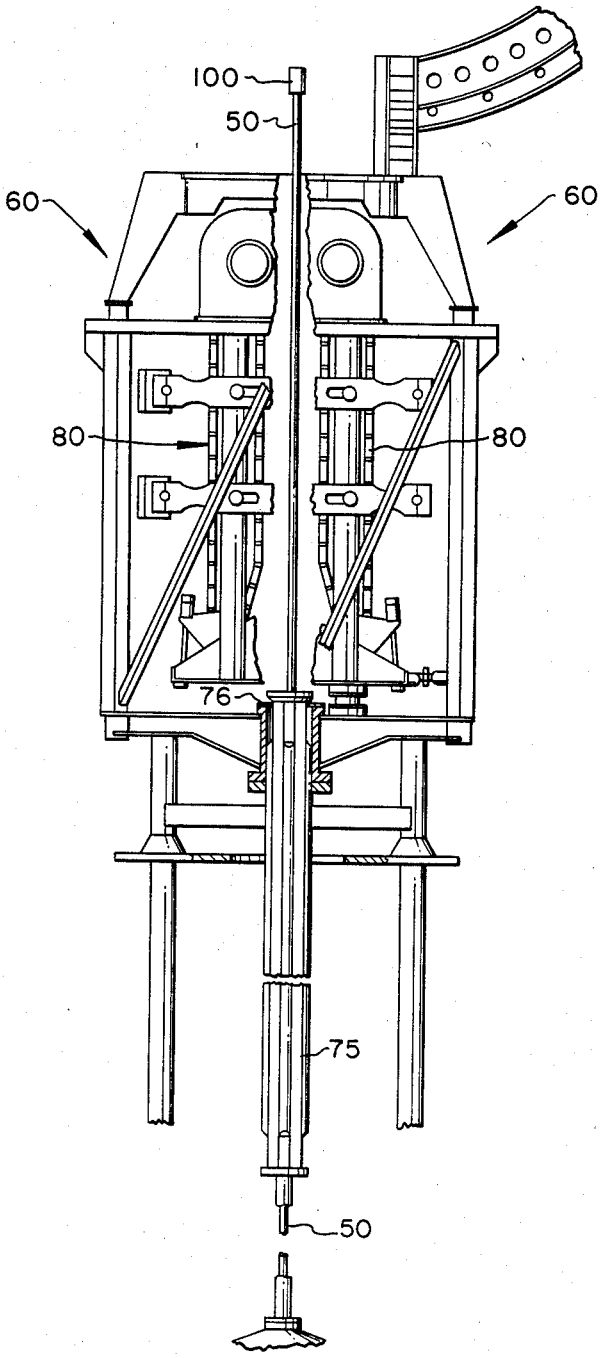
FIG. 7 is a view similar to FIG. 3 but with the chain drive mechanism of the coil tubing injection unit opened and showing the upper end portion of the coil tubing straightened up.
Figure 8:
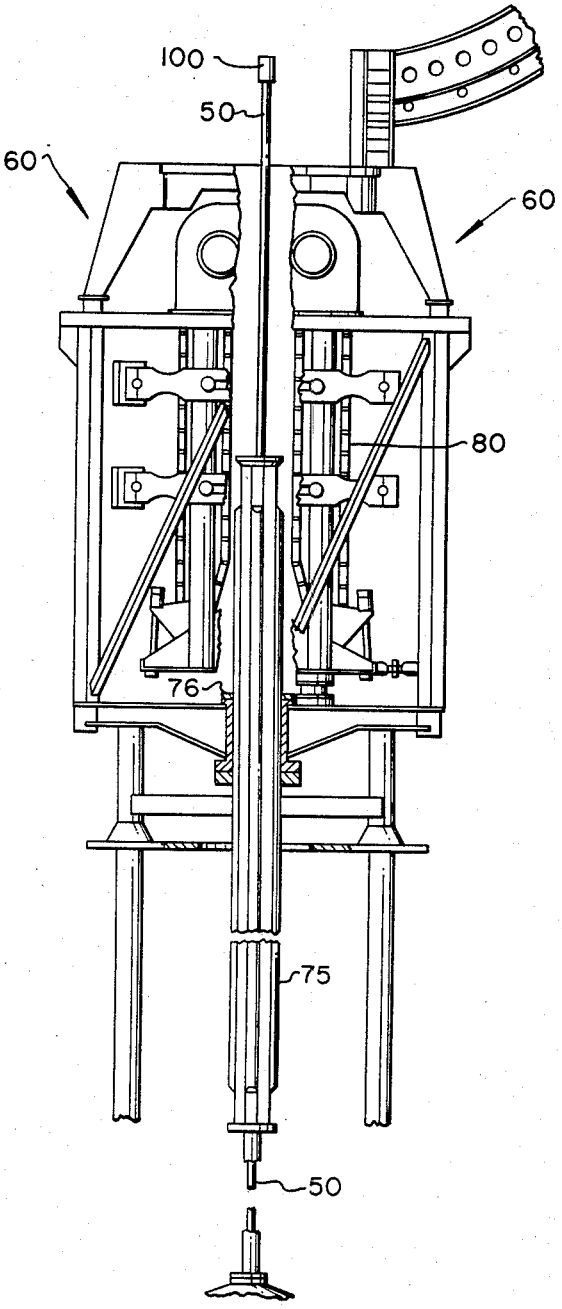
FIG. 8 is a view similar to FIG. 7 but showing the quill being lifted into the open chain drive mechanism from below.

With a connector 100, in suitable form such as, for instance, welded connector 100*a* or non-welded connector 100*b*, secured on the upper end of the straightened coil tubing as seen in FIG. 7, the chain drive mechanism 80 of the injector is opened to its widest, and the quill body 75 is then lifted into position to be gripped in the chain drive mechanism 80. FIG. 8 shows the quill body 75 being thus lifted. The quill body 75 as was explained earlier already surrounds the coil tubing 50.

Figure 9:
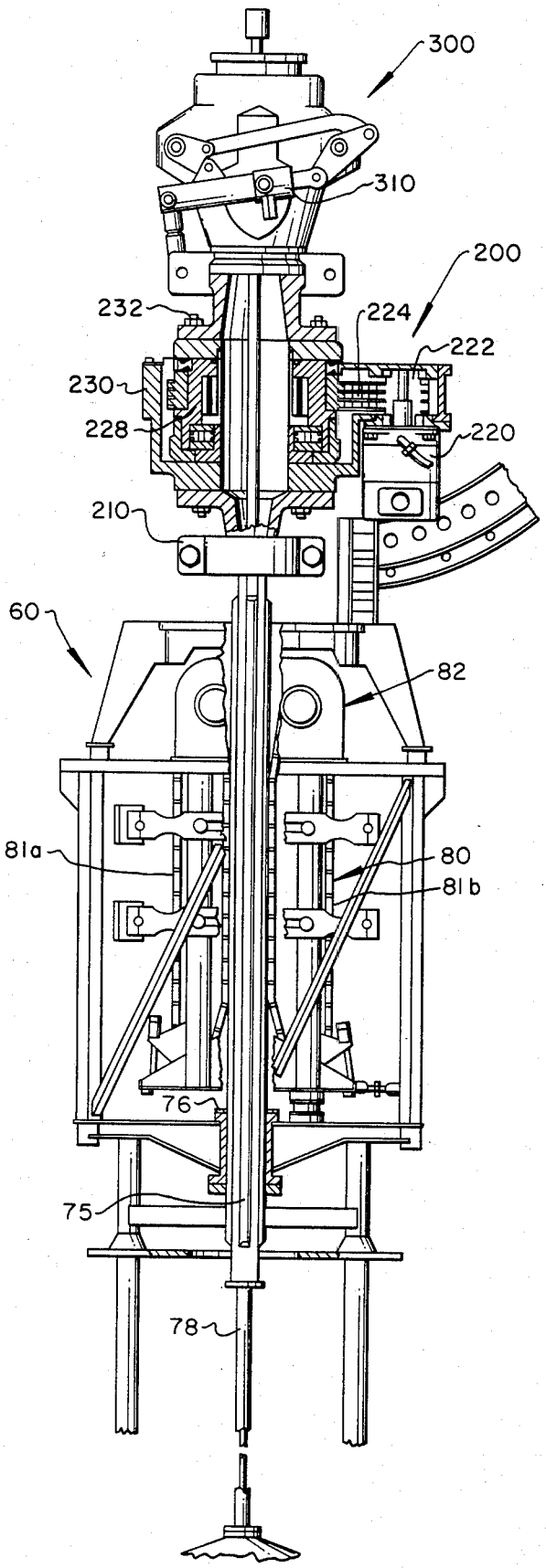
FIG. 9 is a view similar to FIG. 8 but showing the quill engaged in the chain drive mechanism and with a gripper and a rotator mounted on the upper end of the quill.

The quill body 75 is lifted until its upper end is well above the injector 60, then the chain drive mechanism 80 of the injector 60 is closed upon it so that it is firmly gripped between the two chains 81*a* and 81*b*, as seen in FIG. 9. A rotator 200 is then attached to the upper end of the quill body 75 through use of a suitable connection 210, preferably a sturdy union such as the well-known bolted Graylock union available from Gray Oil Tools of Houston, Texas. The rotator 200 is powered by a hydraulic motor 220 having a sprocket 222 for driving chain 224 to rotate the rotatable inner portion 228 of the rotator within the housing 230. A gripper slip assembly 300 is attached to the upper end of the rotatable portion 228 of rotator 200 by bolts 232 as shown. Thus, both the rotator 200 and the gripper slip assembly 300 are mounted upon the upper end of the quill body 75 and are supported thereby. The quill or quill means may be seen to include the quill body 75, the rotator 200, and the gripper slip assembly 300. Hydraulic fluid hoses (not shown) are attached to the piston/cylinder actuator 310 of the gripper 300, and fluid pressure supplied therethrough is used to engage the gripper with the coil tubing, after which the stationary slips 44 are released. It is understood that the two stationary slips 44 and the gripper 300 (commonly called a traveling slip) may be identical. The hydraulic hoses are then disconnected from the gripper 300 and connected to motor 220 of the rotator 200. The coil tubing can then be rotated within the quill body 75 by the rotator 200. By actuating the drive mechanism 80 of the injector 60, the coil tubing can be lifted or lowered while it is, at the same time, being rotated. Obviously, the coil tubing can be moved up or down while it is not being rotated.

Gripper 300 may be like the slip assembly illustrated and described in U.S. Pat. No. 3,215,203 to P. S. Sizer, supra. The rotator 200 may be like or similar to that seen in U.S. Pat. No. 3,191,450.

In many cases it may not be necessary to engage the gripper 300 with the coil tubing since lowering of the coil tubing into the well is usually stopped before the drilling or operating depth has been reached. In such cases, as soon as the quill and its rotator and gripper have been mounted in place in the injector, a length of pipe 110 is threaded into connector 100 and tightened. The injector is then operated to raise the quill, the gripper is engaged with the pipe 110 above connector 100, the stationary slips 44 are released, the rotator 200 is started up if desired, and the injector is actuated to lower the tubing. It may be desirable to lower the coil tubing by adding additional joints of pipe until the operating depth is reached before rotation of the tubing is begun.

Figure 10A:
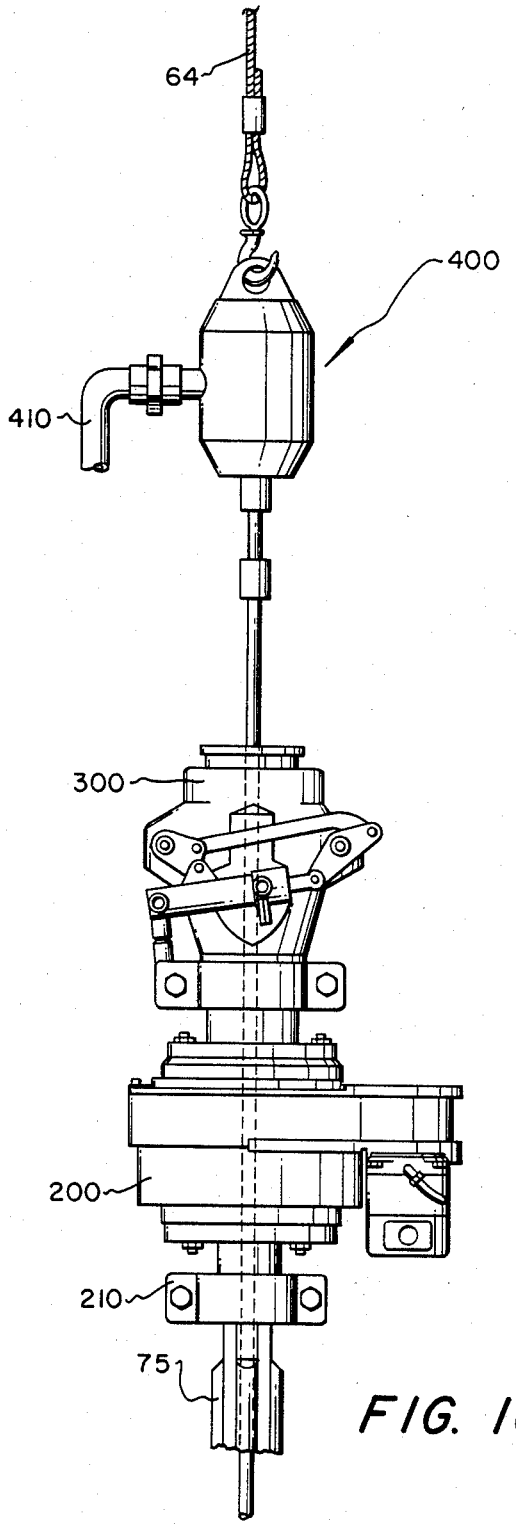
FIGS. 10A and 10B, taken together, constitute a view similar to FIG. 9 but showing a swivel and hose connected to the upper end of the coil tubing or pipe connected to the upper end thereof so that fluids may be forced into the well therethrough.

It is sometimes desirable to pump treating fluids such as water, oil or other fluid, down the coil tubing as it is being rotated and/or moved up or down in the well. For this operation, a swivel such as swivel 400 is connected to the upper end of the pipe 110 as seen in FIG. 10A, or it can be connected directly to the upper end of the coil tubing if necessary, via connector 100. The swivel 400 may be supported by the hoist 63 and cable 64. The swivel 400 has a fluid hose 410 connected either to its side or to its upper end, depending upon the design of the swivel. The other end of the hose 410 is connected to a source of pressurized treating fluid (not shown), for instance, a pump so that fluids may be forced into the well through the coil tubing. The swivel allows the pipe connected thereto to be rotated while the swivel is suspended non-rotatably above the pipe in the conventional manner.

Since the quill body 75 is of limited length, the coil tubing 50 and pipe 110 can be moved by the injector only a few feet each stroke. It can be moved downward until the lowermost position in the injector is reached, and, similarly, it can be moved upward until its uppermost position in the injector is reached. Preferably these upper and lower limits of the quill are determined by suitable limit means such as limit valve means having roller feeler means engaged with the exterior wall of the quill in combination with means such as a recess, shoulder, finger, cam, or the like, carried on the quill so that when the quill reaches its upper or lower limit, the limit valve means will respond and shut off the supply of power fluid to the injector drive mechanism and thus arrest movement of the quill.

Figure 11:
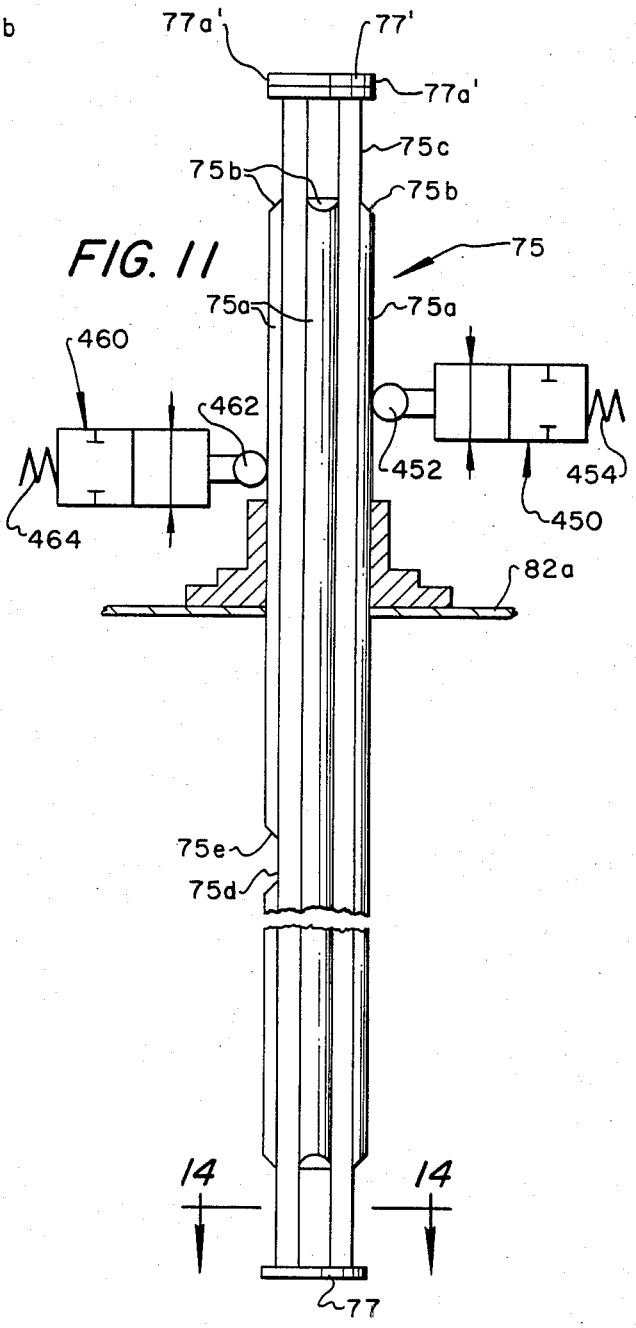
FIG. 11 is a schematical view showing hydraulic means for limiting the stroke of the quill.
Figure 14:
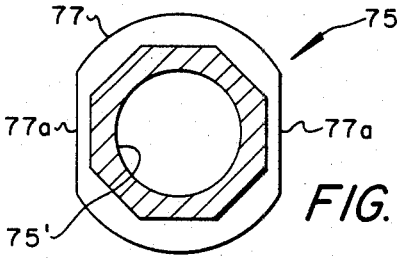
FIG. 14 is a cross-sectional view taken along line 14—14 of FIG. 11.
Figure 20:
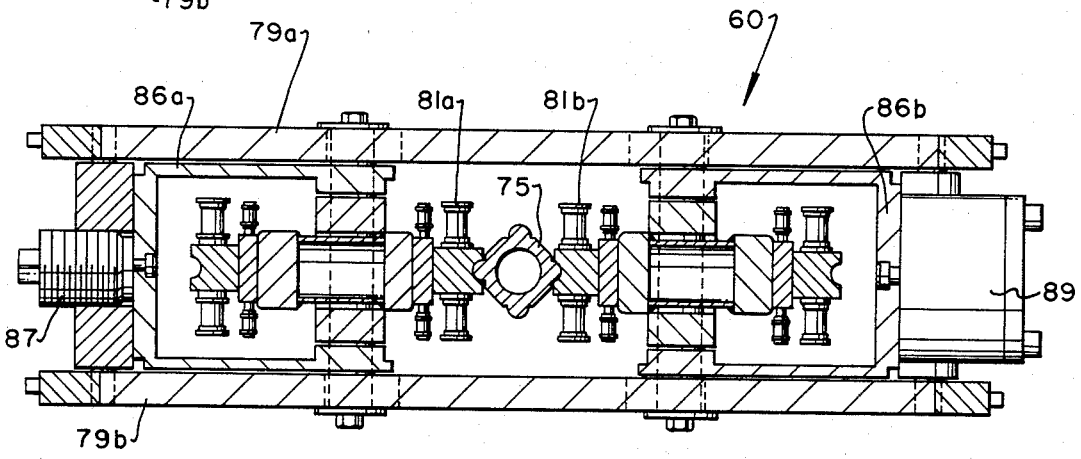
FIG. 20 is a cross-sectional view taken along line 20—20 of FIG. 19.
Figure 18:
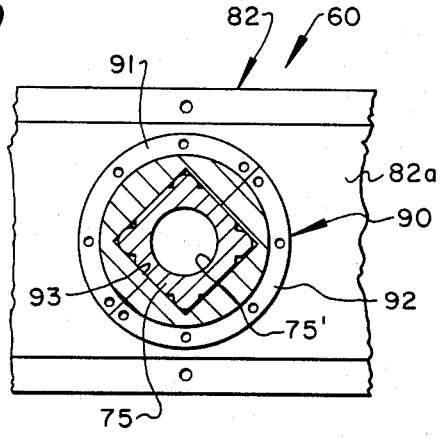
FIG. 18 is a cross-sectional view taken along line 18—18 of FIG. 16, but showing the quill in place.

The quill body 75 may be formed of a tube having a pair of external opposed ribs extending almost its full length and with means on at least one of its ends for attachment to the rotator 200. Quill body 75 is shown in FIGS. 11, 18 and 20 to be formed with a substantially square cross-section with a longitudinal rib 75*a* formed at each corner which is substantially semi-circular in section. The convex semi-circular surface of the ribs has a radius substantially equal to the radius of the coil tubing 50 and the pipe 110, and the chain drive mechanism 80 has gripper blocks 81*c* which are adapted to grip these rounded surfaces of either the pipe or coil tubing or the quill body. The chain drive mechanism 80 grips opposite semi-circular ribs on the quill body 75 and is able to move the quill body upward or downward as desired.

Longitudinal movement of the quill may be limited by any suitable means, as before explained, to avoid pounding at the ends of the strokes. One of the preferred ways of limiting such movement utilizes limit valves as shown schematically in FIGS. 11-12 and will now be explained.

The quill body 75 is provided with at least one pair of opposed longitudinal semi-circular ribs 75*a* which terminate short of the upper end of the body, and the upper end of each of these ribs is inclined inwardly and upwardly to form a cam surface 75*b* and forming the lower end of a recess 75*c*. At least one of the ribs 75*a* is provided with a recess 75*d*, and this recess provides a cam surface as at 75*e*. Recess 75*d* obviously is spaced below recess 75*c*.

A pair of cam actuated, spring returned, two-position, two-way limit valves 450 and 460 are mounted on the coil tubing injector 60 so that their cam followers or rollers 452 and 462 are engageable by the cam surfaces 75*b* and 75*e*, respectively. Thus when the quill body 75 moves down sufficiently far, the cam follower 452 will move out into recess 75*c* and the limit valve 450 will be shifted by its spring 454 from its fluid passing position (shown) to its fluid blocking position (not shown). When valve 450 thus blocks the passage of fluid, it shuts off supply of power fluid to the power means 82 and therefore the chain drive mechanism 80 and stops downward movement of the quill body 75. When the quill body moves up again, the cam surface 75*b* will engage and depress the cam roller 452 and will shift valve 450 back to its passing position (shown).

Thus downward movement of the quill is arrested by shutting off the hydraulic drive means 82 of the injector before the quill bumps bottom. This avoids needless and, perhaps, damaging impacts.

In a similar manner, when the quill body 75 moves up sufficiently far, cam roller 462 will engage recess 75*d*, and limit valve 460 will be shifted by its spring 464 from its fluid passing position (shown) to its fluid blocking position (not shown). When valve 460 thus blocks the passage of fluid, it shuts off supply of power fluid to the chain drive mechanism 80 as before explained and stops upward movement of the quill body. When the quill body moves down again, cam surface 75*e* will engage and depress cam roller 462 and will shift valve 460 back to its fluid passing position (shown).

Figure 12:
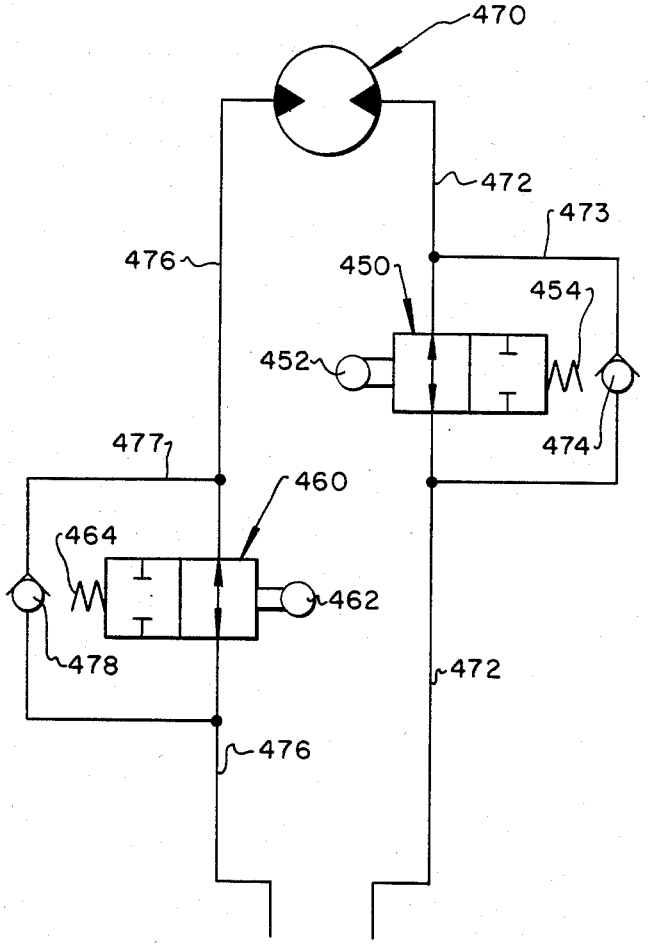
FIG. 12 is a diagram of a portion of the hydraulic circuitry for operating the stroke limiting means of FIG. 11.
Figure 10B:
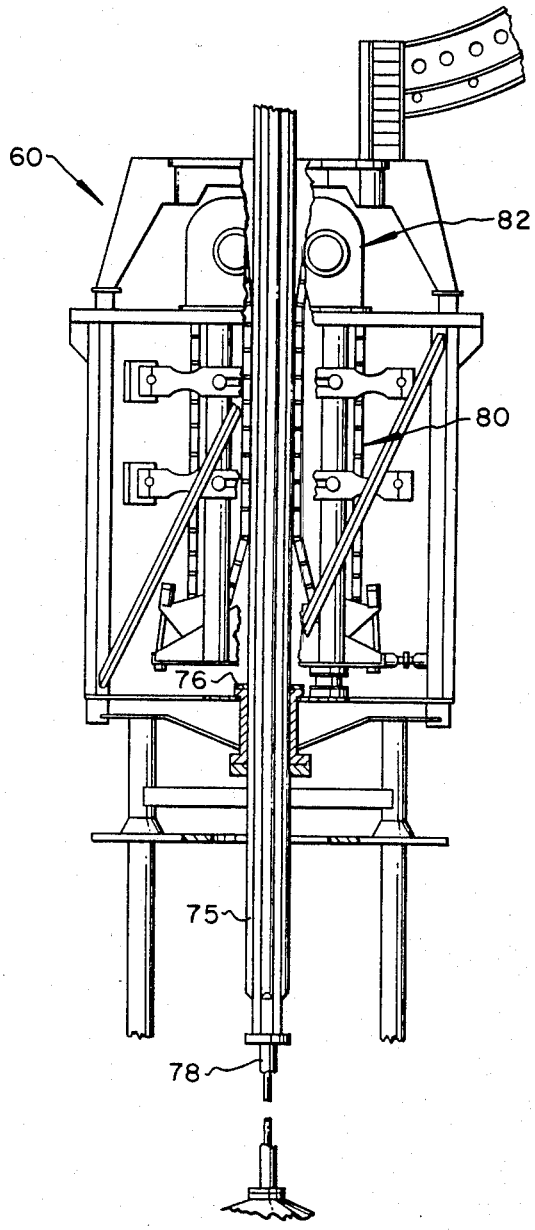

Referring now to FIG. 12, it will be seen how the limit valves 450 and 460 control the flow pressurized hydraulic power fluid to the power means 82 of the injector 60.

In FIG. 12, hydraulic motor 470 which is a part of the power means 82 which powers the chain drive mechanism 80 is supplied power fluid through power fluid branches 472 and 476 which are connected between motor 470 and control means (not shown) which in turn is connected to a power fluid source (not shown) such as a suitable hydraulic pump. The control (not shown) is used to direct power fluid through the circuit 472, 476 in a selected direction to cause the quill to move up or down, as desired.

Both limit valves 450 and 460 are shown in fluid passing position as they understandably would be when the quill is in an intermediate position, as shown in FIG. 11.

Downward movement of the quill occurs when power fluid is directed through the circuit 476, 472 in a counter-clockwise direction as seen in FIG. 12. Power fluid will pass through conduit 472 and through limit valve 450 to power the motor 470. Spent power fluid is exhausted from motor 470 through conduit 476 and limit valve 460 as well as through bypass conduit 477 and check valve 478 back to tank (not shown). When, however, cam follower 452 of limit valve 450 enters recess 75*c* of the quill, limit valve 450 shifts from its passing to its blocking position and power fluid cannot pass through limit valve 450 to motor 470. Neither can power fluid pass through bypass conduit 473 because check valve 474 will not allow flow in that direction. Motor 470 is thus starved, and downward movement of the quill is quickly arrested, but without pounding.

Limit valve 460 remains open as shown.

To cause the quill to move in the reverse direction, that is, to cause it to move upward, power fluid is directed through circuit 476, 472 in a clockwise direction. Power fluid then passes through conduit 476 and limit valve 460 to motor 470. Exhaust fluid flows from motor 470 through conduit 472, but since limit valve 450 is at this time closed, exhaust fluid cannot pass through it. It can, however, bypass valve 450 by flowing through bypass conduit 473 and through check valve 474. Thus, motor 470 can be operated in this reverse direction to drive the quill upward.

As the quill moves upward, cam surface 75*b* thereon will shift limit valve 450 back to fluid passing position (shown).

When quill 75 approaches the limit of its upward travel, cam follower 462 of limit valve 460 enters recess 75*d* of the quill, and this causes limit valve 460 to shift to its fluid blocking position to shut off supply of power fluid to motor 470. This stops upward movement of the quill since power fluid can neither pass through valve 460 nor through bypass check valve 478.

Movement of the quill is then reversed by reversing the direction of the power fluid. Thus, power fluid is directed through circuit 472, 476 in a counter-clockwise direction as before. Power fluid passes through conduit 472 and the now open limit valve 450 to motor 470. Exhaust fluid from motor 470 passes through conduit 476 and bypasses closed limit valve 460 by passing through bypass conduit 477 and through check valve 478. As soon as quill 75 has moved down a little, cam surface 75*e* of the quill will engage cam roller 462 of limit valve 460 and will cause valve 460 to shift to its open or fluid passing position.

Thus, the circuitry of FIG. 12 can be used to control the upward and downward travel of the quill and to limit such travel in each such direction.

Positive limit means is also provided to limit longitudinal movement of the quill by the chain drive mechanism of the coil tubing injector.

It is readily seen that the union 210 or the rotator 200 cannot enter the upper end of the injector. Thus there is no chance that the quill could move down too far in the injector or be dropped through it.

Figure 13:
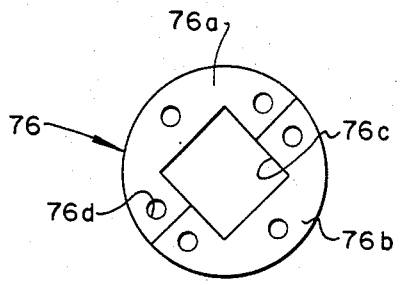
FIG. 13 is a top view of a two-piece plate for positively limiting upward travel of the quill in the injecting unit.

Further, the lower end of the quill body 75 extends through the stroke limit plate 76. This plate 76 is seen in FIG. 13. It is formed in two halves, 76*a* and 76*b*. These two halves together form a circular plate having a square opening 76*c* through its center and a plurality of bolt holes 76*d* circumferentially spaced thereabout near its rim. The two halves of the plate are placed about the quill body so that the quill body is properly oriented therein, then the halves are bolted to the injector below the chain drive mechanism 80 thereof as seen in FIGS. 1 and 9.

The quill body is formed with an external flange 77 at least on its lower end, and preferably a like or similar flange 77' on its upper end as well. It is also preferable to form such flange or flanges to the shape of a Graylock hub. This is especially true of the upper end of the quill body since it must be attached to the lower end of the rotator 200. This hub will fit the Graylock clamp which is the outer part of the Graylock union 210. Thus, the quill body could be made symmetrical with both ends identical. Of course, if this is done, a second recess like recess 75*d* must be provided so that limit valve 460 will be effective to limit downwad travel of the quill if and when the quill body is inverted.

The hub or flange 77 being larger than the square opening 76*c* of the stroke limit plate 76 cannot pass therethrough. Thus, the quill body can be lifted only until flange 77 engages the stroke limit plate 76.

Since the quill body must pass between the opposed drive chains 81*a* and 81*b* of the chain drive mechanism 80 and since the distance between these chains is limited, it may be preferable to form flats such as opposed flat surface 77*a* on opposite sides of the flange or hub 77 (and hub 77' as well) so that the quill body may be inserted into the chain drive mechanism as desired. The flats on the upper hub 77' are indicated by the reference numeral 77*a'*.

The stroke limit plate 76 will not only limit upward travel of the quill body 75, but since its square hole 76*c* receives the square section of the quill body with a sliding fit, the plate 76 will prevent rotation of the quill body relative to the injector and the well.

The plate 76 may be provided with a round opening therethrough for receiving the quill body, in which case the plate would not prevent relative rotation of the quill body. In such case, other means must be provided to prevent such relative rotation. Such anti-rotation means may be provided in the form of a split plate similar to the plate 76 but bolted to the housing 82*a* of the power means 82 at the upper end of the injector as will be explained later in connection with FIGS. 15–20.

Because the coil tubing 50 does not have great column strength, it is easily bent under a column load such as when the chain drive mechanism 80 of the injector 60 applies a downward axial force thereto to push the coil tubing through the blowout preventer 34 and into the well 20. If the coil tubing is not provided adequate support, it will buckle and bend rather than moving through the blowout preventer. This could cause failure of the tubing and may result in a "blowout". Naturally, the higher the well pressure, the greater the lateral support needed to avoid such buckling of the coil tubing. This lateral support can be readily provided by a guide tube similar to that taught in U.S. Pat. No. 3,690,136 mentioned earlier.

In the present invention, the guide tube may be like or similar to that shown in FIGS. 2, 3, 7, 8, 9, 10B and 15B where it is indicated generally by the reference numeral 78. The upper end of the guide tube 78 is telescoped into bore 75' of the quill body 75 as shown in FIG. 2. Its lower end extends from the quill and is preferably secured in such position that when the quill is at the upper limit of its stroke, several inches of the guide tube will still be telescoped into the quill. The guide tube 78 is, therefore, preferably provided with a flange 78, or the like, on its lower end so that it may be fastened to a suitable structure such as a platform (not shown) provided beneath the injector 50 or, preferably, to the stationary slips 44.

The coil tubing 50 passes through the quill 75 and the guide tube 78 telescoped thereinto. Thus, close lateral restraint is provided to limit lateral movement of the coil tubing to prevent buckling and bending thereof even when a full-length stroke is taken.

Thus far, this invention has been explained with respect to FIGS. 1–14 which show an apparatus for lowering a length of coil tubing into a well and then rotating the coil tubing to perform desired operations downhole. The apparatus shown is capable of both rotating the coil tubing and moving it longitudinally either concurrently or independently. Also, the coil tubing can be lowered further into the well by adding one or more joints of pipe to the upper end thereof to extend its length and thus increase its reach into the well. These operations are made possible by use of a quill assembly which surrounds the pipe or coil tubing and is engageable by the injector. The quill carries gripping means for gripping the pipe or coil tubing, and the gripping means is rotatably mounted on the quill so that the coil tubing or pipe can be rotated through the quill while the quill is in the firm grip of the injector. Power means is provided for rotating the gripping means.

In the apparatus of FIGS. 1–14, the quill body 75 is stored out of the way but kept at the ready by suspending it below the injector 60 with the coil tubing passing through its bore 75'. When it is needed, the injector drive chains are moved apart and the quill body is lifted to a level therebetween to be engaged thereby, as before explained. After this, the rotator and the gripping means are attached atop the quill body.

Figure 15A:
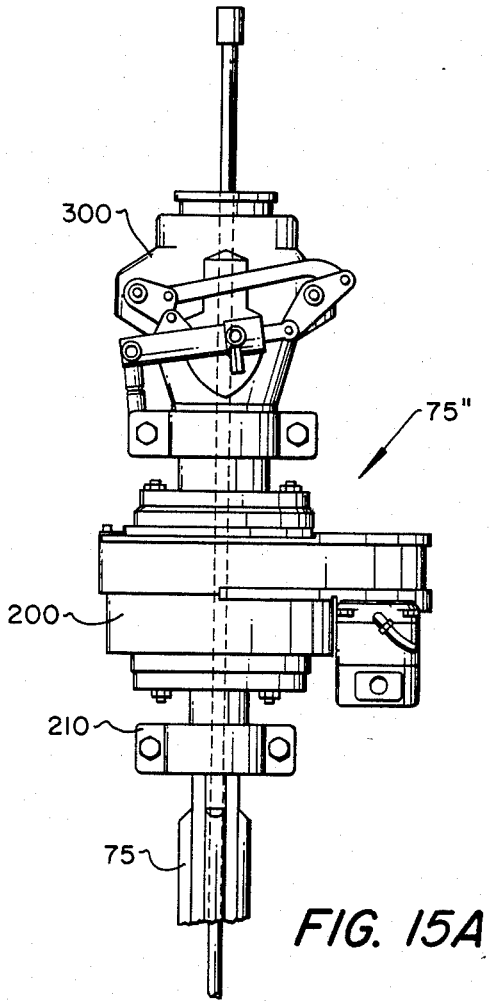
FIGS. 15A and 15B, taken together, constitute a view similar to FIG. 9 but showing the quill, rotator, and gripper in pre-assembled form, being lowered into the coil tubing injection unit from above, the chain drive mechanism being not yet opened to receive the quill.
Figure 15B:
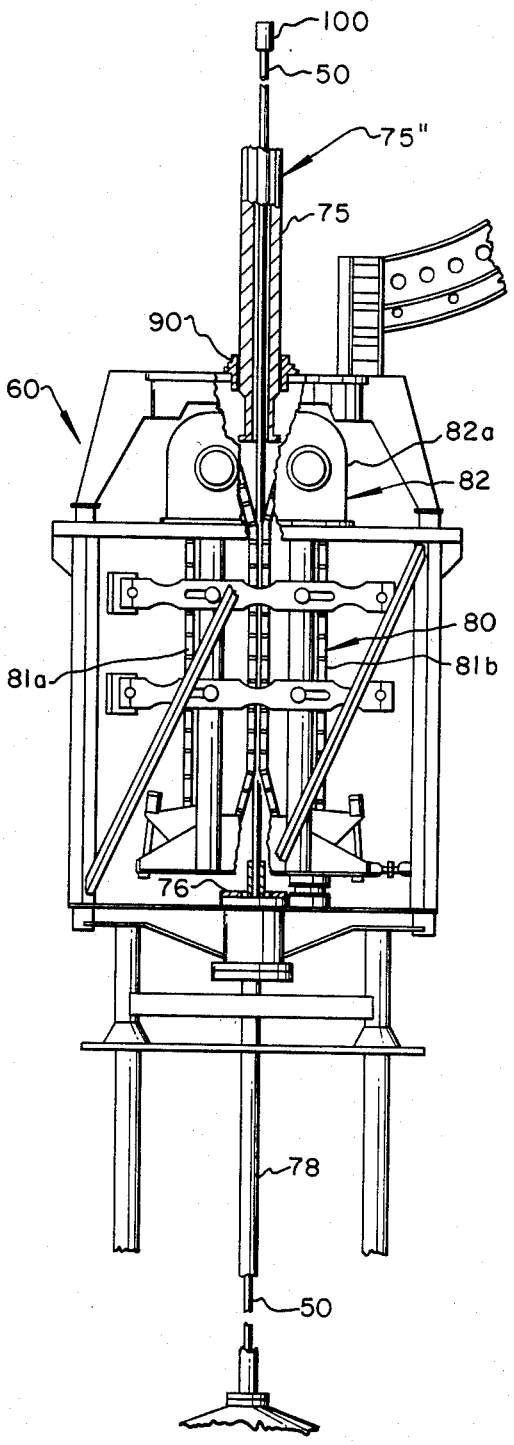

In FIGS. 15A and 15B, a modified form of the invention is shown in which the quill is not lifted into the chain drive mechanism from below but is lowered thereinto from above. The injector and quill mechanism in both cases may be identical. Therefore, the injector is again indicated generally by the reference numeral 60. The quill assembly comprising the quill body 75, the rotator 200 and the gripper 300 is indicated generally by the numeral 75'' and is preferably kept assembled and stored outside the injector 60. Then, when ready, the drive chains 81*a* and 81*b* are moved apart, the quill assembly 75'' lifted above the injector, and then it is lowered between the drive chains. As shown in FIG. 18, the lower end of the quill is inserted into the injector, and anti-rotation means such as the anti-rotation plate 90 is assembled thereabout and secured to the motor cover 82*a* on upper end of the injector, the plate 90 being formed in two halves 91 and 92 as shown. The anti-rotation plate 90 is similar to stroke limiting plate 76 in that it is formed with a square opening therethrough and is split into halves as shown. The square opening 93 receives the square quill body 75. Since the plate 90 is secured to the housing 82*a*, it will not permit the quill to rotate in the injector as the rotator 200 and gripper 300 grip and rotate the pipe 110. In addition, the stroke limit plate 76 is removed below the injector and reassembled about the quill after the lower end of the quill is moved downward past the plate's normal position after which the plate 76 is re-installed to positively limit upward movement stroke of the quill in the injector.

The quill and injector are then ready to operate as before explained.

It will be noted that the injector and quill operate to accomplish the same thing in the same manner whether the quill is inserted into the injector from above or from below. If the quill is lifted into the injector from below, there must be provided adequate space between the injector 60 and the stationary slips 44 in which the quill body 75 can hang out of the way until needed. The rotator and gripper cannot be attached to the quill until the quill is lifted and its upper end projects well above the injector. On the other hand, if the quill is to be lowered into the injector from above when needed, the quill body 75, rotator 200, and gripper 300 can be preassembled and set aside until needed, then installed as a unit. This could save time, and less space beneath the injector will be needed. Preferences, safety, savings in time and money, and convenience will dictate whether to insert the quill into the injector from above or from below.

Figure 16:
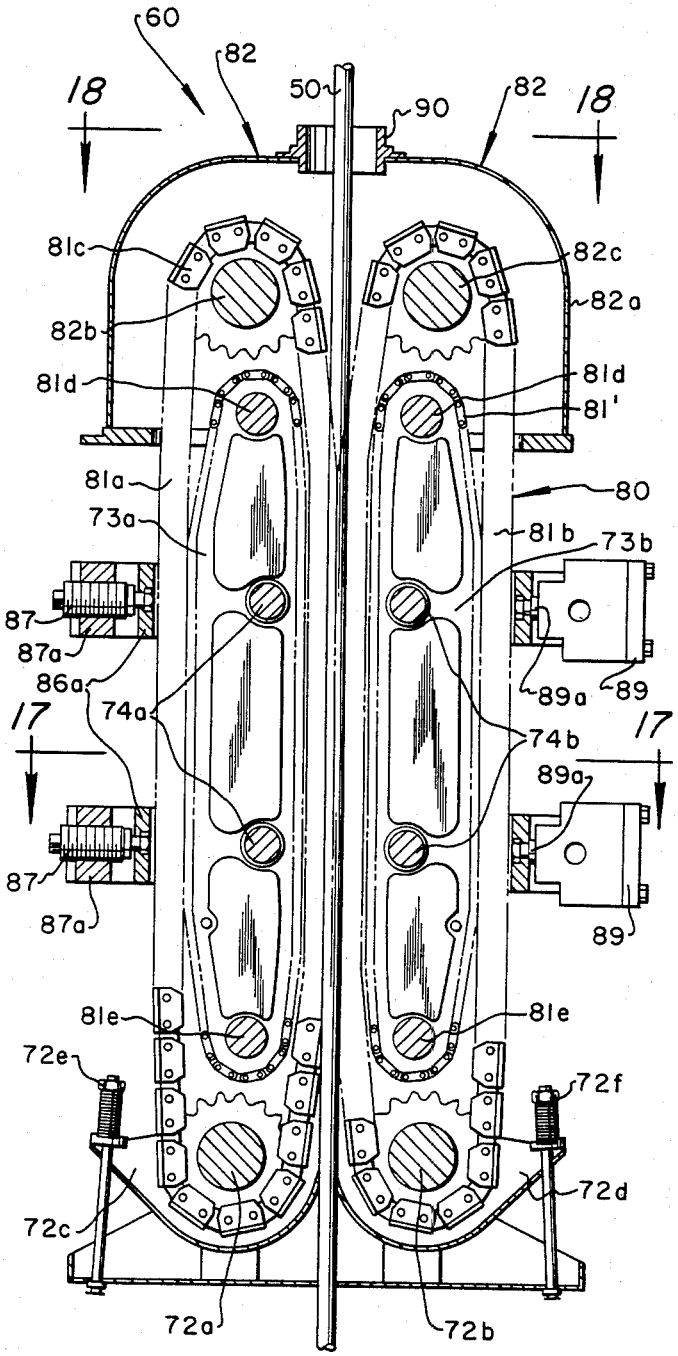
FIG. 16 is a longitudinal view, partly in elevation and partly in section with some parts broken away, showing the coil tubing injector of this invention with coil tubing engaged therein.
Figure 17:
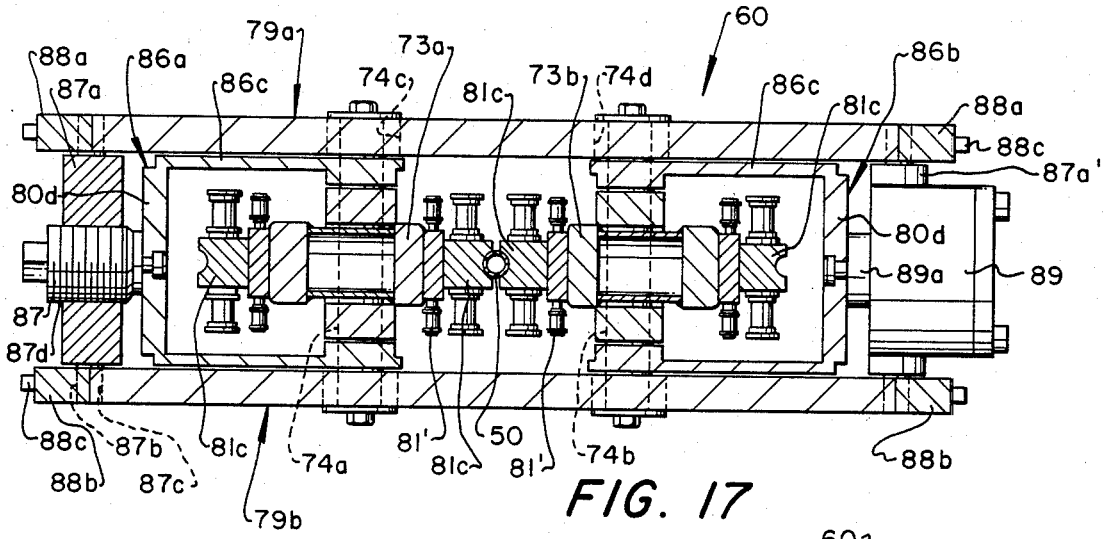
FIG. 17 is a cross-sectional view taken along line 17—17 of FIG. 16.

The injector 60 is shown in part in FIGS. 16–20. The injector 60 is shown in FIGS. 16 and 17 with coil tubing in its grip. Injector 60 includes the chain drive mechanism 80 which includes a pair of endless drive chains 81*a* and 81*b* spaced apart and arranged as shown. The pair of drive chains 81*a* and 81*b* are movable toward and away from each other. They are driven by power means 82 having a housing 82*a* and a pair of drive sprockets 82*b* and 82*c* which engage the drive chains and are supported by the housing or cover 82*a*. The drive sprockets are driven by motors (not shown) which are housed under the cover 82*a*. The drive chains 81*a* and 81*b* also pass around idler sprockets 72*a* and 72*b* which are spaced well below the drive sprockets as shown. Each of the drive chains 81*a* and 81*b* is provided with gripper blocks 81*c* which are adapted to conform to and frictionally engage and grip the coil tubing 50, pipe 110, or quill body 75.

A pair of pressure beams 73*a* and 73*b* are mounted within endless chains 81*a* and 81*b*, respectively, and are carried on clevis pins 74*a* and 74*b* which are mounted for limited horizontal movement in slots 74*c* and 74*d* of side plates 79*a* and 79*b* permitting the chains to be moved apart sufficiently to allow the quill to be placed therebetween as before explained.

Within each of the drive chains 81*a* and 81*b* is an endless roller chain 81' which passes around its respective pressure beam 73*a* or 73*b* and passes around upper and lower sprockets 81*d* and 81*e*, respectively.

It is readily seen that when the pressure beams are moved toward each other, the drive chains 81*a* and 81*b* will be pressed against any coil tubing, pipe, or the quill which happens to be therebetween. The roller chain 81' is squeezed between the pressure beam, and the drive chain and its rollers reduce the friction and permit the drive sprockets 82*b* to drive the drive chains with reduced horsepower and energy to move the coil tubing, pipe, or quill up and/or down.

The lower idler sprockets 72*a* and 72*b* are preferably carried on swingable housings 72*c* and 72*d* which can be moved by tightening or loosening adjusting nuts 72*e* and 72*f* to increase or decrease tension in the drive chains. The lower sprockets 81*e* serve to maintain their respective roller chain 77 with its rollers substantially horizontal.

Each drive chain 81*a* or 81*b* is moved toward and away from the coil having 50 as seen in FIG. 17 by means which will now be described.

A pair of clevises 86*a* and 86*b* is mounted for horizontal movement, each having an opening in each of its legs 86*c*. Pin 74*a* passes through the holes in clevis 86*a*, and pin 74*b* passes through the holes in clevis 86*b* so that the clevis and the pressure beam 73*a* move together. Each clevis passes around the outer side of the pressure beam and chains as shown. Clevis 86*a* has its outer end 80*d* swivelly connected to the inner end of threaded adjustable stop screw 87 which is threaded into a yoke member 87*a* having trunnions 87*b* at its opposite ends secured in suitable mated recesses 87*c* formed in the ends of side plates 79*a* and 79*b* and end pieces 88*a* and 88*b* as shown. The end pieces are secured to the ends of the side plates by suitable bolts 88*c*. Threaded stop screw 87 is adjusted by turning it to operate its thread 87*d* to move the screw in or out as desired. Suitable means (not shown) for locking the screw 87 at the adjusted position are well known and may be provided as desired.

Clevis 86*b* similarly has arms 86*c* with openings through the ends thereof and with pin 74*b* passing therethrough so that clevis 86*b* and pressure beam 73*b* will move together. The outer end 80*d* of clevis 86*b* is secured to the end of piston 89*a* of hydraulic cyliner 89. Cylinder 89 is secured in place by a yoke 87*a'* which is much like yoke 87*a* and has trunnions at its opposite ends received in aligned recesses formed in the ends of the side plates 79*a* and 79*b* and in the end pieces 88*a* and 88*b*, and these end pieces are secured in place by bolts 88*c* in the manner before explained with respect to yoke 87*a*.

The hydraulic cylinder 89 is actuated by hydraulic fluid pressure introduced thereinto in the usual manner to extend and retract its piston 89*a*. The piston moves the clevis 86*b* and the pressure beam 73*b* toward the left as seen in FIG. 17. The beam 73*b* forces the drive chain 81*b* into contact with the coil tubing 50 and also pushes the coil tubing, drive chain 81*a*, pressure beam 73*a* and clevis 86*a* to the left until stopped by adjusting screw 87. Further movement of piston 89*a* causes the coil tubing 50 to be squeezed between the gripper blocks 81*c* of drive chains 81*a* and 81*b* and thus be firmly gripped. The drive chains may then be set in motion to apply an upward or downward force of the coil tubing to move it into or out of the well as desired. Retracting the piston 89*a* will loosen the grip of the drive chains on the coil tubing when desired. Roller chains 81' reduce the friction between the drive chains and pressure beams as before explained.

Figure 19:
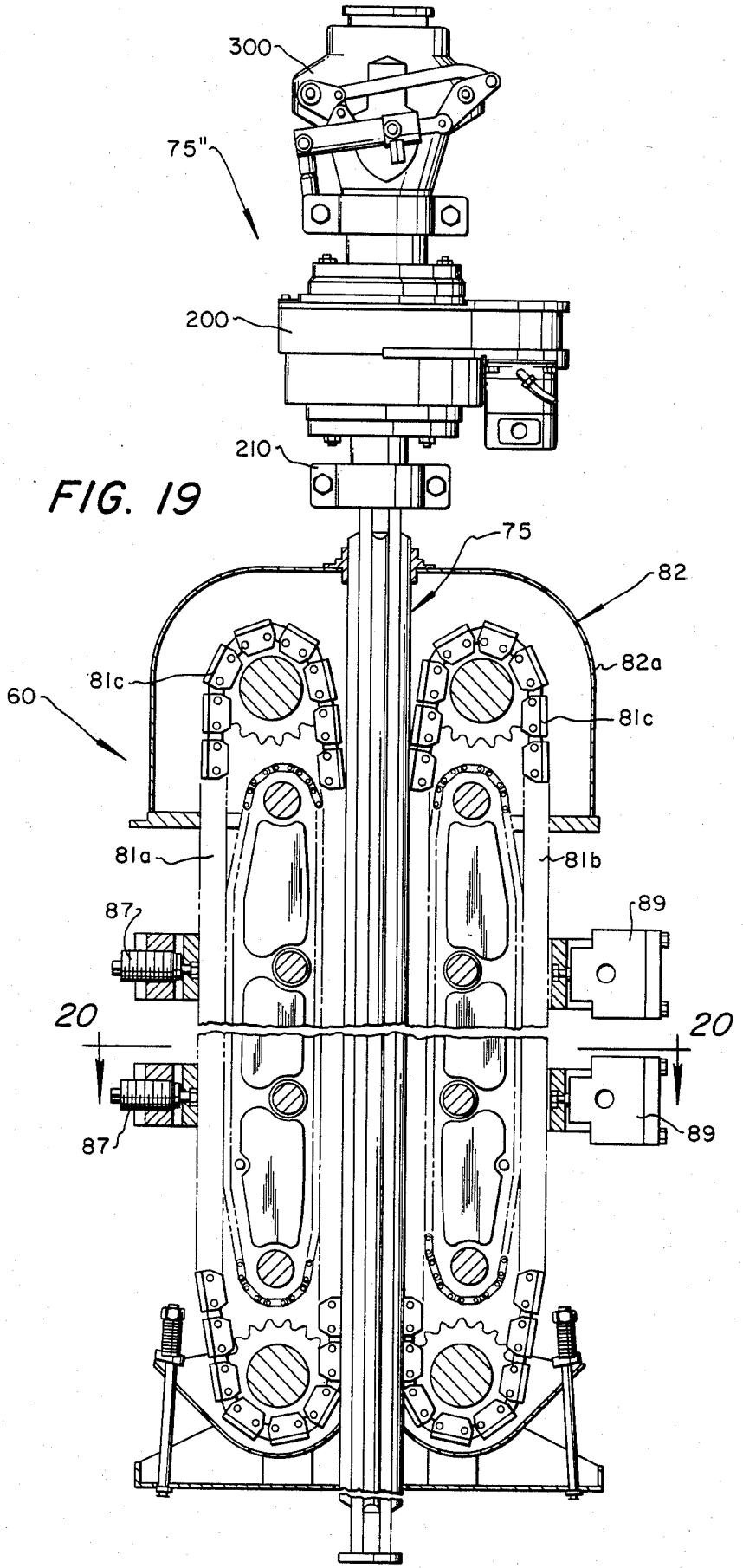
FIG. 19 is a view similar to FIG. 16 but showing the coil tubing injector with the quill assembly engaged therein.

To release the coil tubing 50 from the grip of the chain drive mechanism, hydraulic fluid pressure is redirected to the piston/cylinder 89 to retract the piston 89*a* which moves the right hand clevis 86*b*, pressure beam 73*b*, drive chain 81*b*, and roller chain 81' to their rightmost position. If the quill is to be used, the adjusting screw 81 is backed out, and in so doing it will pull the left-hand clevis 86*a*, pressure beam 73*a*, roller chain 81', and drive chain 81*a* to their leftmost position. With the drive chains 81*a* and 81*b* at their maximum separation, the quill body 75 can be placed therebetween as before explained and as seen in FIGS. 18 and 19. After placing the quill between the drive chains, the adjusting screw 87 is adjusted as desired to provide a secure grip of the drive chain mechanism on the coil tubing, pipe, or the quill when the drive chains are again actuated to gripping position.

Thus, it has been shown that the apparatus and methods illustrated and described hereinabove fulfill all of the objects set forth early in this application.

It has been shown that the improved coil tubing injector 60, the quill 75, the gripper 300, the rotator 200, and connector 100 (either 100*a* or 100*b*) find utility in running a length of coil tubing into a well and then rotating the coil tubing while it is in the well to perform desired operations downhole, such as drilling out obstructions, for example, sand bridges, or the like. It has been shown that jointed pipe can be added to the upper end of the coil tubing to increase its reach into the well and that the coil tubing may thereby be further lowered into the well and may even be rotated while it is being lowered. Further, it has been shown that a quill has been provided which can be placed in a position surrounding the pipe or coil tubing, that the quill is formed with at least one pair of opposed longitudinally extending ribs on its exterior surface and that these ribs simulate the size and shape of the coil tubing and pipe, thus enabling the injector to grip and drive the quill in the same way that it engages and drives coil tubing; and that the quill makes it possible to move the pipe and/or tubing up and down while rotating at the same time. Also, it is understandable that, while the pipe and coil tubing are substantially equal in diameter, and either could be driven by the injector, the quill, having a sufficiently large bore therethrough, makes it possible to pass the couplings of the jointed pipe through the injector which could not otherwise handle them since they are too large for the gripper pads. It was also shown that certain downhole operations may be quickly completed by running coil tubing into a well through use of a coil tubing injector, with much saving in time and money since the coil tubing can be moved continuously, and then when the operating depth is reached, a quill can be added to the upper end of the coil tubing to make it possible to rotate the tubing for performing those operations. It has been shown that the disclosed apparatus is provided with limiting means for automatically stopping the quill both at the upper end of its stroke and at the lower end thereof; that such limiting means is operated by coengageable limit means on the quill and on the injector; that there is provided further limit means which come into play should the automatic limit means fail; and that these last limit means provide definite limits beyond which it is impossible for the quill to move. Additionally, it has been shown that the apparatus disclosed hereinabove makes it possible to practice the methods outlined herein for expediently servicing wells by installing coil tubing in a well and then rotating the coil tubing to perform downhole operations such as drilling out sand bridges or other obstructions, or similar operations.

The foregoing description and drawings have been herein presented by way of explanation only, and changes in materials, arrangement of elements and sizes thereof, as well as variations in the methods, may be had within the scope of the appended claims without departing from the true spirit of this invention.

We claim:

1. Apparatus for injecting coil tubing into a well for performing a downhole operation which requires rotation thereof, comprising:

a. means for injecting coil tubing into a well;

b. quill means for surrounding said coil tubing and being movable longitudinally by said injecting means;

c. means for releasably gripping said coil tubing, said gripping means being rotatably supported by said quill means and movable therewith; and d. means for rotating said gripping means relative to said quill means.

2. The apparatus of claim 1, wherein said means for injecting coil tubing into the well includes means engageable with said quill means for counteracting the rotational forces applied to said coil tubing to rotate the same.

3. Apparatus for injecting coil tubing into a well for performing a downhole operation which requires rotation thereof, comprising:

a. means for injecting coil tubing into the well;

b. connecting means for connecting jointed pipe to the upper end of the coil tubing to extend the length thereof;

c. tubular quill means for surrounding the pipe or coil tubing, said quill means being movable longitudinally by said injecting means;

d. means for releasably gripping the pipe or coil tubing, said gripping means being rotatably supported by said quill means and movable therewith; and e. means for rotating said gripping means relative to said quill means.

4. The apparatus of claim 3, wherein said means for injecting coil tubing into the well includes means engageable with said quill means for counteracting the rotational forces applied to said coil tubing to rotate the same.

5. The apparatus of claim 4, wherein said injecting means further includes stationary slips for releasably engaging and supporting the coil tubing in said well.

6. The apparatus of claim 5, including limit means on said quill and on said injecting means coengageable to limit longitudinal movement of said quill relative to said injecting means.

7. The apparatus of claim 6, wherein injecting means is powered by hydraulic fluid pressure and said limit means includes at least one limit valve operable by hydraulic fluid pressure.

8. The apparatus of claim 7, including:

a. stop shoulder means on said quill means;

b. stroke limiting plate means having an aperture therethrough, the dimension of said aperture being smaller than the dimension of said quill means at said stop shoulder means, said plate being mountable about said quill means above said shoulder means and attachable to said injecting means, whereby engagement of said stop shoulder means with said stroke limiting plate positively limits upward movement of said quill means relative to said injection means.

9. The apparatus of claim 8, including a length of coil tubing.

10. The apparatus of claim 9, wherein said length of coil tubing contains check valve means for preventing the flow of well fluids from the well through said coil tubing.

11. The apparatus of claim 10, including a length of pipe connectable to said connecting means at the upper end of said length of coil tubing for extending the length of said coil tubing.

12. The apparatus of claim 3, wherein said connector means is attached to said coil tubing by welding.

13. The apparatus of claim 3, wherein said connecting means is a packoff overshot comprising:

a. tubular body means having means at one of its ends for attachment to a joint of pipe and the other of its ends providing an open socket for receiving an end of said coil tubing in telescoping relation;

b. gripping means in said body for gripping said coil tubing and securing said connector means thereto;

c. seal means for sealing between said connector means and said coil tubing; and d. means in said body and means on said coil tubing coengageable to prevent relative rotational movement therebetween.

14. A coil tubing injector for injecting coil tubing into a well and being capable of using a quill to allow rotating the coil tubing in the well, said injector comprising:

frame means; and b. endless-type chain drive mechanism mounted in said frame means for driving coil tubing into and out of a well, said drive mechanism including:

i. drive chain means including a pair of opposed endless chains disposed in a common plane and being movable toward and away from each other to grip and release coil tubing disposed therebetween, ii. means for moving said chain means laterally between inner gripping and outer releasing positions, iii. means for driving said chain means to drive the coil tubing into or out of the well, and iv. means defining the location of said inner and outer positions for both said coil tubing and said quill, said coil tubing and said quill being unequal in transverse dimension.

15. The coil tubing injector of claim 14, including quill means, comprising:

a. an elongate tubular body having a bore therethrough, said body having exterior surfaces engageable by said drive chain means for moving said quill means longitudinally relative to said frame means;

b. means rotatably supported by said quill means for releasably gripping a coil tubing or pipe disposed in the bore of said quill means; and c. means for rotating said gripping means relative to said quill means.

16. The coil tubing injector of claim 15, including stationary slip means for releasably engaging and holding coil tubing or pipe against relative longitudinal movement.

17. Quill means for use with a coil tubing injector to permit rotation of coil tubing or pipe about its longitudinal axis while extending into a well, comprising:

a. elongate body means having a longitudinal bore therethrough for receiving said coil tubing or pipe, said body having an exterior surface capable of being gripped by said coil tubing injector;

b. gripping means rotatably supported by said elongate body means for releasably gripping and holding pipe or coil tubing disposed therein; and c. means for rotating said gripping means relative to said elongate body means.

18. The quill of claim 17, wherein said elongate body is formed with limit means for engaging limit valve means on said coil tubing injector to limit relative longitudinal movement of said quill.

19. The quill of claim 17, wherein said rotator is powered by fluid pressure.

20. A method of servicing a well, comprising:

a. installing a length of coil tubing in the well through use of a coil tubing injector; and b. rotating said length of coil tubing to perform a downhole operation in the well.

21. The method of claim 20, wherein said length of coil tubing is provided with an operational tool at its lower end and a check valve above said operational tool.

22. The method of claim 21, including the further step of moving said length of coil tubing longitudinally while it is being rotated.

23. The method of claim 21, including the additional step of circulating fluid through said length of coil tubing while it is being rotated.

24. The method of claim 20, including the additional steps of:

a. severing the coil tubing at the surface after its lower end has reached the desired depth in the well; and b. attaching a connector to the upper end of the length of coil tubing in the well to prepare the coil tubing for subsequent attachment of a length of pipe.

25. The method of claim 24, including the additional step of adding a length of pipe to the upper end of said length of coil tubing to extend the length thereof.

26. The method of claim 25, including the additional step of further lowering said length of coil tubing into the well through use of said length of pipe attached thereto.

27. The method of claim 25, including the additional steps of:

a. removing the length of pipe from the length of coil tubing; and b. withdrawing the length of coil tubing from the well.

28. The method of claim 24, including the additional steps of:

a. cutting the coil tubing to length before it is lowered into the well; and b. attaching to the upper end thereof a connector for attachment of a length of pipe.

29. The method of claim 28, including the additional steps of:

a. removing the length of pipe from the length of coil tubing; and b. withdrawing the length of coil tubing from the well.

30. The method of claim 20, including the additional steps of:

a. placing elongate tubular quill means about the upper end portion of said length of coil tubing, said quill means having gripping means rotatably supported thereon;

b. gripping the coil tubing with said gripping means; and c. moving said length of coil tubing longitudinally by moving said quill through use of a coil tubing injector.

31. The method of claim 30, wherein said quill means includes means for rotating said gripping means, and said method includes the further step of rotating said length of coil tubing by rotating said gripping means.

32. The method of claim 31, wherein said quill and said coil tubing injector are provided with travel limiting means for limiting the longitudinal movement of the quill relative to the coil tubing injector.

33. The method of claim 32, wherein said tubular quill, gripping means, and rotating means are connected together before they are telescoped over the upper end of the coil tubing.

34. The method of claim 32, wherein the tubular quill is suspended below the drive chain mechanism and the coil tubing is run through the tubular quill and into the well.

35. The method of claim 34, wherein upon disengagement of the tubular quill from the chain drive mechanism, it is again suspended therebelow.

36. A method of servicing a well comprising the steps of:

a. attaching an operational tool and a check valve to the lower end of coil tubing;

b. running said coil tubing to a desired depth in the well through use of a coil tubing injector;

c. supporting said coil tubing at the surface with stationary slips;

d. severing said coil tubing at a location spaced above said stationary slips and attaching a connector to the end of the coil tubing extending from the well, the free end of said connector having means for attachment to a length of pipe;

e. telescoping a tubular quill over the free end of the coil tubing and engaging said quill in said coil tubing injector, said quill supporting gripping means thereon;

f. connecting a length of pipe to said connector on said coil tubing;

g. activating said gripping means supported on said quill to grip said pipe or said coil tubing;

h. releasing said stationary slips; and i. operating said coil tubing injector to move said quill and said coil tubing supported thereby longitudinally.

37. The method of claim 36, wherein said gripping means is rotatably supported by said quill and said quill includes means for rotating said gripping means relative to said quill, and said method includes the additional step of rotating said gripping means and the coil tubing supported thereby to rotate said operational tool on the lower end of said coil tubing.

38. The method of claim 37, including the further steps of:

a. disconnecting said length of pipe from said coil tubing;

b. disengaging said quill from said coil tubing injector; and c. removing said coil tubing from said well using said coil tubing injector.

39. The method of claim 37, including the further step of circulating fluid through said coil tubing, check valve, and operational tool while rotating the same relative to said tubular quill.

* * * * *